United States Patent [19]

Schmidt

[11] Patent Number: 4,592,156

[45] Date of Patent: Jun. 3, 1986

[54] SNOWBLOWER

[75] Inventor: Alfred Schmidt, Bernau, Fed. Rep. of Germany

[73] Assignee: Ing. Alfred Schmidt GmbH, Blasien, Fed. Rep. of Germany

[21] Appl. No.: 748,103

[22] Filed: Jun. 24, 1985

[30] Foreign Application Priority Data

Jun. 3, 1984 [DE] Fed. Rep. of Germany ..... 3424236

[51] Int. Cl.[4] ..... E01H 5/09

[52] U.S. Cl. ..... 37/250; 37/255

[58] Field of Search ..... 37/250, 255, 256, 247–249, 37/210, 211, 213

[56] References Cited

U.S. PATENT DOCUMENTS

| | | | |
|---|---|---|---|
| 1,233,664 | 7/1917 | Heitmann | 37/211 |
| 1,393,935 | 10/1921 | Bekkerus | 37/211 |
| 1,673,457 | 6/1928 | Jensen | 37/255 X |
| 2,723,470 | 11/1955 | Harnack | 37/250 |
| 4,346,527 | 8/1982 | Schmidt | 37/250 |

FOREIGN PATENT DOCUMENTS

| | | | |
|---|---|---|---|
| 955576 | 11/1947 | France | 37/250 |

*Primary Examiner*—E. H. Eickholt

*Attorney, Agent, or Firm*—George E. Kersey

[57] ABSTRACT

A snowblower for use particularly with wet and heavy snow formed by a precutting device (8) which rotates about the axis of a blower wheel (4) and is situated in front of the blower wheel in the snow clearing direction. Also included are worm gears (2,3) which rotate about vertical axes and are disposed on both sides in front of the blower wheel (4). The precutting device (8) has radial cutting arms (9) with radii corresponding to the radius of the blower wheel (4). The rotational bodies formed by the precutting device and the worm gears interact with one another without contact.

6 Claims, 2 Drawing Figures

SNOWBLOWER

BACKGROUND OF THE INVENTION

The invention concerns a snowblower comprising a blower wheel whose rotational axis runs horizontally in the snow-clearing direction; a precutting device which rotates about the same rotational axis, positioned before the blower wheel in the snow-clearing direction; and snow-clearing worm gears which rotate about vertical axes, positioned on both sides in front of the blower wheel.

Such a snowblower is disclosed in German Pat. No. 2,721,411, making it possible to feed the laterally disposed snow to the blower wheel. The snow is transported upwardly in the snow-clearing worm gears and is thrown in front of the blower wheel openings. This effect can be achieved as long as the snow is loose. If the snow is wet and heavy, snow easily jams in front of the blower wheel. In that case the snow-clearing worm gears turn idly, and the blower wheel pushes a wall of snow before it, without having the snow reach the interior of the machine. A precutting device which rotates between the worm gears is largely ineffective since its diameter is limited to the spacing between the worm gears and since it does not operate close to the ground.

By contrast with the prior art, the invention is based on the objective of improving a snowblower of the type mentioned above so that it is also effective with wet, heavy snow.

According to the invention, this is achieved by providing the precutting device with radial arms, each having a radius corresponding approximately to that of the blower wheel. The rotating bodies that are formed by the precutting device, and by the snow-clearing worm gears, are phased with respect to one another as seen from the top of the machine. The result is that the respective rotating parts interact without contact.

The invention not only provides a non-contacting engagement of the cutting arms of the precutting device, and of the snow-clearing worm gears, it also provides that the snow-clearing worm gears are appropriately proportioned so that the rotating bodies are near to one another without making actual contact. It is desirable for the snow-clearing worm gears at an appropriate low level, so that the precutting device extends above them. The snow-clearing worm gears preferably have deflecting plates on their backsides, where these plates pivot about vertical axes. Consequently the snow which is grasped and transported upwardly can not be blown laterally or backwards.

As with known snowblowers, the snow-clearing worm gears can be disposed so that they can pivot about vertical axes. Thus the spacing between them is variable. In this connection, the invention provides that the minimum spacing between the vertical axes of the snow-clearing worm gears is slightly larger than the diameter of the blower wheel. With this arrangement, the snow-clearing worm gears remain effective for feeding snow into the opening of the blower wheel. Because of the mutual engagement of the worm gears and the precutting device, it is possible that the cutting arms can be suitably long, approximately equal to the diameter of the cutting wheel. Thus even if layers of snow close to the ground are loosened by the precutting device the buildup of snow blockage, especially with very moist snow is avoided both in front of the wheel and in front of the snow-clearing worm gears. The dimentioning of the precutting device also facilitates better cutting of frozen snow.

In a preferred embodiment, the snow-clearing worm gears have a height which corresponds approximately to the diameter of the blower wheel. Their center section is designed to fit in accordance with the diameter of the precutting device. With this embodiment the snowblower can clear relatively high walls of snow and snow drifts.

In another embodiment, the snow-clearing worm gears extend from the vicinity of ground level to a horizontal plan through the rotational axis of the blower wheel. Their upper section is matched to the rotational form of the precutting device. This embodiment can be produced economically since the snow-clearing worm gears can be relatively short. In addition, this embodiment is adequate for most snow clearing purposes, at least for snow with a height lying below the rotational axis of the blower wheel.

In keeping with the invention, the precutting device can be of arbitrary design. The cutting arms can be straight or spiral in shape. They can have cutting surfaces or they can spread in a circumferential direction along their ends. They also can be composed of radial cutting bars and throw bars that run in a circumferential direction.

DESCRIPTION OF THE DRAWINGS

An illustrative embodiment of the invention is considered in conjunction with the drawings in which.

DETAILED DESCRIPTION

Figure 1:
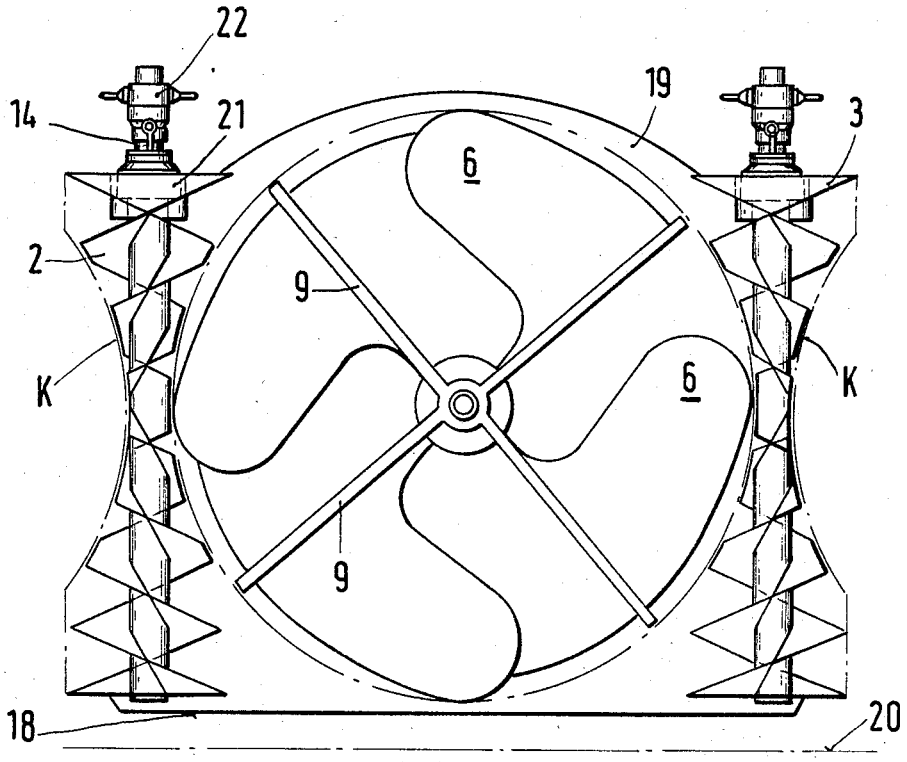
FIG. 1 is a front view of a snowblower in accordance with the invention.
Figure 2:
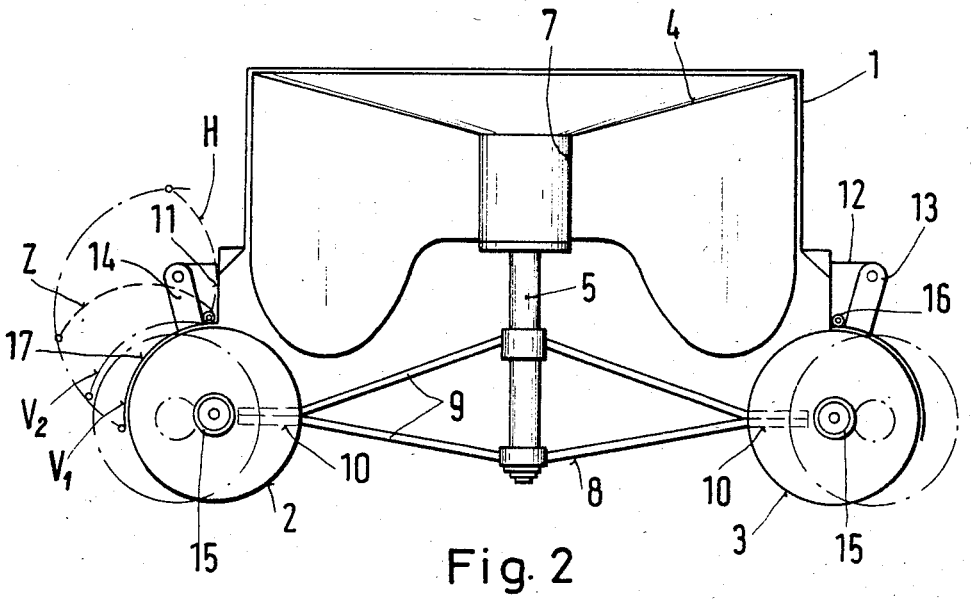
FIG. 2 is a top view of the snowblower of FIG. 1.

With reference to FIGS. 1 and 2, a snowblower in accordance with the invention includes a blower wheel housing 1 for a blower wheel 4 and two snow-clearing worm gears 2 and 3 which are disposed laterally and frontally with respect to the blower wheel 4. The ejection channel of the snowblower is not shown in the drawings. The blower wheel 4 also has five blades 6. The hub 7 of the blower wheel has an extension shaft 5 towards the front on which is fastened a precutting device 8 with cutting arms 9. The blower wheel housing 1 extends in a forward direction towards the snow clearing side by a housing 11. At a lateral protrusion 12 of the housing 11, there are pivot arms 14 which can pivot about vertical axes 13. Shafts 15 are mounted at the free ends of the pivot arms. The worm gears 2 and 3 rotate about these shafts. Hinges 16 for pivoting deflecting plates 17 are provides laterally in the housing 11. These deflection plates cover the snow-clearing worm gears 2 and 3 towards the rear.

The pivoting motion of the third arms 14 and the deflection plates 17 is suitably achieved by using hydraulic pistons. These pistons have the usual design and are therefore not shown in detail. In the drawing, the snow-clearing worm gears 2 and 3 are indicated in the position where they are maximally inwards. The outward position is indicated by dot-dashed lines.

Considering as an example the left snow-clearing worm gear 2, FIG. 2 shows the associated deflection plate 17 in various positions. In the forward position $B_1$, the plate is pivoted inwardly. In the forward position $B_2$, the deflection plate is pivoted outwardly. In an intermediate position Z, the deflection plate enlarges the snow-clearing width, while position H is for rearward non-engagement.

The lateral outside contour of the rotational body that is formed by the snow-clearing worm gears 2 and 3 is shown by the line K in dots and dashes. The outside contour K represents the generating envelope of the rotational bodies. The central, fixed area of the contour K corresponds to the cutting that is made with the precutting device 8. In FIG. 2 the precutting device 8 is shown with its cutting arms 9 in a horizontal position. The ends 10 of the cutting arms 9 are shown with dashes. In the top view of FIG. 2 it can be seen to what extent the rotational bodies formed by the snow-clearing worm gears 2 and 3, and by the precutting device 8, engage one another.

At its lower side, the snowblower is bounded by a ground knife 18. As is common with snowblowers, the ground knife is fastened on an eyeglass-like housing section 19, which frames the blower wheel. In FIG. 1 the ground surface 20 below the ground knife 18 is also indicated with a line of dots and dashes.

At the upper end of each snow-clearing worm gear 2 and 3, there is a seated a planetary gear 21 that is recessed in the front side of each worm gear. The planetary gear 21 is driven by a hydraulic rotating motor 22 disposed above it. A pivot arm 14 is hinged between these two parts.

What is claimed is:

1. A snowblower comprising a blower wheel (4) with a horizontal rotational axis running in the direction in which snow is being cleared;

a precutting device (8) which rotates about the same rotational axis and is disposed in front of the blower wheel in the snow clearing direction; and snow-clearing worm gears (2,3) which rotate about vertical axes and are disposed on both sides in front of the blower wheel; characterized in that the precutting device (8) has radial cutting arms (9) each with a radius corresponding approximately to the radius of the blower wheel (4); and the rotational bodies formed by the precutting device (8) and the worm gears (2, 3) are tailored to one another, at least as seen from the top, so that the respective rotating parts interact with one another without contact.

2. A snowblower according to claim 1, characterized in that the minimum distance between the vertical axes of the worm gears (2,3) is larger than the diameter of the blower wheel.

3. A snowblower according to claim 1, characterized in that the height of the worm gears (2,3) correspond to the diameter of the blower wheel, and their center section fit into the diameter of the precutting device (8).

4. A snowblower according to claim 2, characterized in that the height of the worm gears (2,3) correspond to the diameter of the blower wheel, and their center section fit into the diameter of the precutting device (8).

5. A snowblower according to claim 1, characterized in that the snow-clearing worm gears (2,3) extend from the vicinity of ground to at least a horizontal plane through the rotational axis of the blower wheel (4), and the upper profile of each of the worm gears (2,3) is matched to the rotational form of the precutting device (8).

6. A snowblower according to claim 2, characterized in that the snow-clearing worm gears (2,3) extend from the vicinity of ground to at least a horizontal plane through the rotational axis of the blower wheel (4), and the upper profile of each of the worm gears (2,3) is matched to the rotational form of the precutting device (8).

* * * * *